US006691337B1

(12) United States Patent
Banks

(10) Patent No.: US 6,691,337 B1
(45) Date of Patent: Feb. 17, 2004

(54) CUSHIONED BATHTUB SUPPORT APPARATUS

(76) Inventor: Aaron J. Banks, 53 Farragut Pl., NW., Washington, DC (US) 20011

( * ) Notice: Subject to any disclaimer, the term of this patent is extended or adjusted under 35 U.S.C. 154(b) by 0 days.

(21) Appl. No.: 10/326,518

(22) Filed: Dec. 20, 2002

(51) Int. Cl.[7] ..... A47K 3/024

(52) U.S. Cl. ..... 4/575.1; 4/573.1; 4/578.1; 4/579; 4/571.1

(58) Field of Search ..... 4/575.1, 573.1, 4/571.1, 579, 580, 581, 582, 583, 659, 588, 592, 593, 584, 578.1, 565.1, 560.1; 5/632, 633, 646, 652, 653, 654, 656; 441/125, 126, 127, 129, 130

(56) References Cited

U.S. PATENT DOCUMENTS

| | | | | | |
|---|---|---|---|---|---|
| 3,117,327 | A | * | 1/1964 | Mathew | 441/132 |
| 3,233,940 | A | * | 2/1966 | Tooley, Jr. | 297/188.18 |
| 3,896,796 | A | | 7/1975 | Soderblom | 128/36 |
| 3,909,859 | A | * | 10/1975 | Harris | 4/575.1 |
| 3,969,776 | A | * | 7/1976 | Gildea | 4/575.1 |
| 4,037,591 | A | * | 7/1977 | Sarno | 4/573.1 |
| 4,564,240 | A | * | 1/1986 | Thieme | 441/129 |
| 4,662,852 | A | * | 5/1987 | Schneider et al. | 441/132 |
| 4,780,916 | A | | 11/1988 | Sutton | 4/543 |
| 4,935,972 | A | | 6/1990 | Brady | 4/575 |
| 5,004,296 | A | * | 4/1991 | Ziegenfuss, Jr. | 441/132 |
| 5,181,284 | A | * | 1/1993 | Raphael et al. | 4/572.1 |
| D335,036 | S | * | 4/1993 | Simmons | D6/361 |
| D339,631 | S | * | 9/1993 | Benson-Gilchrist | D23/278 |
| 5,321,859 | A | * | 6/1994 | Buckshaw et al. | 4/572.1 |
| 5,341,525 | A | * | 8/1994 | Tillman et al. | 4/579 |
| D352,994 | S | * | 11/1994 | Parker | D23/304 |
| 5,403,220 | A | * | 4/1995 | Goad, Sr. | 441/130 |
| 5,518,431 | A | * | 5/1996 | Staley | 441/130 |
| D371,252 | S | * | 7/1996 | Chaput | D6/381 |
| 5,535,458 | A | * | 7/1996 | Siverly | 4/579 |
| 5,715,546 | A | | 2/1998 | Kvalvik | 4/580 |
| 5,829,070 | A | * | 11/1998 | Taylor | 4/578.1 |
| 6,035,459 | A | * | 3/2000 | Sadek | 4/560.1 |
| 6,086,150 | A | * | 7/2000 | Scheurer et al. | 441/129 |
| 6,102,759 | A | * | 8/2000 | Klimenko | 441/129 |
| 6,183,430 | B1 | | 2/2001 | Lin | 601/168 |
| 6,199,226 | B1 | * | 3/2001 | Steadman | 4/565.1 |
| 6,378,147 | B1 | * | 4/2002 | Halleran | 4/579 |

FOREIGN PATENT DOCUMENTS

| | | | | | |
|---|---|---|---|---|---|
| JP | 06237873 | A | * | 8/1994 | 4/575.1 |

* cited by examiner

*Primary Examiner*—Steven O. Douglas
*Assistant Examiner*—Khoa D. Huynh
(74) *Attorney, Agent, or Firm*—Sturm & Fix LLP

(57) ABSTRACT

A cushioned support apparatus (10) for use in combination with a conventional bathtub/spa (100) wherein the support apparatus (10) includes a pair of extension arm members (30) (30') formed integrally with a main upper body support unit (11) having an upper backrest portion (25) wherein, the upperback rest portion (26) is also provided with an elongated non-skid friction skirt member (40); and, wherein, the pair of extension arm members (30) (30') are further provided with a plurality of contoured recesses (33) (34) dimensioned to receive and support bath accessories (200) and (201).

14 Claims, 2 Drawing Sheets

CUSHIONED BATHTUB SUPPORT APPARATUS

BACKGROUND OF THE INVENTION

CROSS REFERENCE TO RELATED APPLICATIONS

Not applicable.

1. Field of the Invention

The present invention relates to the field of cushioned bathroom accessories in general and in particular to a cushioned support apparatus for bathtubs that is adapted to releasably receive a plurality of bath related receptacles.

2. Description of Related Art

As can be seen by reference to the following U.S. Pat. Nos. 5,715,546; 6,183,430; 3,896,796; and, 4,780,916, the prior art is replete with myriad and diverse padded bathroom accessories employed for a variety of different purposes.

While all of the aforementioned prior art constructions are more than adequate for the basic purpose and function for which they have been specifically designed, they are uniformly deficient with respect to their failure to provide a simple, efficient, and practical cushioned bathtub support apparatus that is adapted to releasably receive and securely retain a variety of diverse articles that the user would desire to have close at hand while bathing or soaking in a bathtub or spa. These items include but are not limited to: bubble bath, scented bath oils, therapeutic bath salts, and beverages which are intended to be consumed rather than spilled into the tub or spa or onto the floor.

As a consequence of the foregoing situation, there has existed a longstanding need among those individuals that enjoy luxuriating in a tub or spa for a new and improved cushioned bathtub support apparatus that has extension arms provided with retaining recesses for receiving diverse receptacles and for preventing them form spilling or tipping over while the user is in the tub; and, the provision of such an arrangement is the stated objective of the present invention.

BRIEF SUMMARY OF THE INVENTION

Briefly stated, the support apparatus that forms the basis of the present invention comprises in general a cushioned upper body support unit, a pair of arm units and a lower body friction unit wherein the pair of arm units are formed integrally with the cushioned upper body support unit and the lower body friction unit is connected to and suspended beneath the upper body support unit.

As will be explained in greater detail further on in the specification, both the upper body support unit and the arm units are fabricated primarily from a molded contoured waterproof material wherein the upper body support unit has a hollow interior chamber and each of the arm units is provided with lateral stiffening elements and a plurality of contoured recesses dimensioned to receive and support a variety of common bath accessories in a relatively spill proof manner.

In addition, the lower body friction unit resembles an elongated flexible skid proof bath mat which is suspended from the upper body support unit to prevent the user's body slipping downwardly in a smooth sided bathtub spa once they have achieved a desired relaxed position relative to the upper body support unit wherein the lower body friction unit may optionally be provided with a waterproof cushion element for added comfort.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
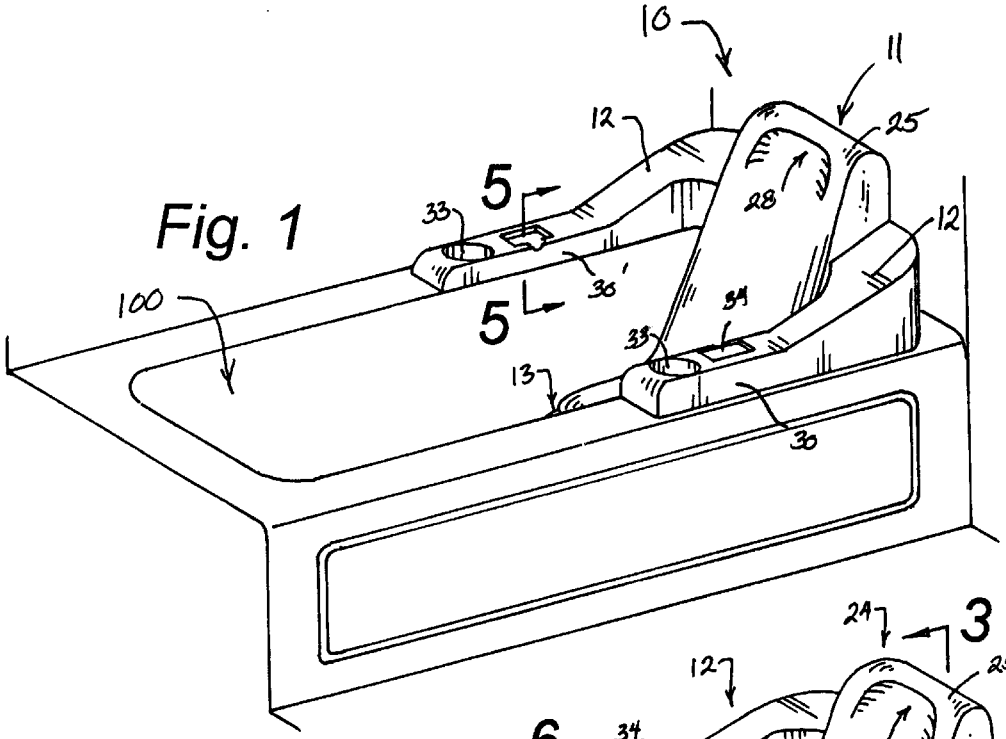
FIG. 1 is a perspective view of the support apparatus disposed in a conventional bathtub.
Figure 2:
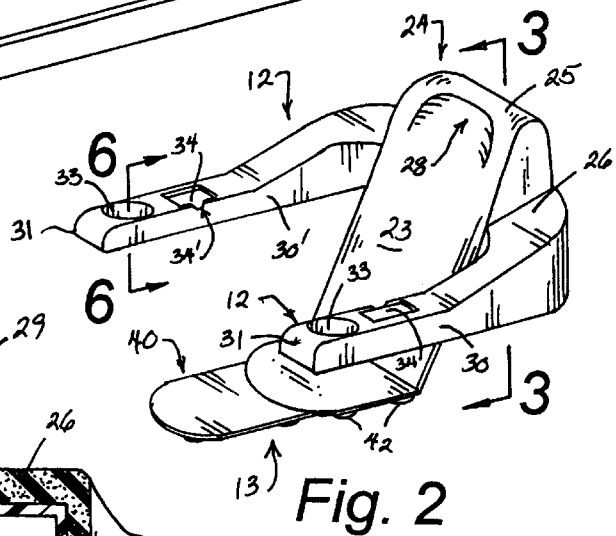
FIG. 2 is an isolated perspective view of the support apparatus.

As can be seen by reference to the drawings, and in particular to FIGS. 1 and 2, the cushioned bathtub support apparatus that forms the basis of the present invention is designated generally by the reference number 10. The support apparatus 10 comprises in general a main cushioned upper body support unit 11, a pair of arm units 12 12, and a lower body friction unit 13. These units will now be described in seriatim fashion.

As shown in FIGS. 1 through 4, the main upper body support unit 11 comprises an enlarged contoured cushioned support member 20 having a generally flat base 21, a generally planar vertical rear face 22, an angled front face 23 and a top surface 24 having a tapered raised headrest portion 25 that merges with and is centrally disposed on an upper backrest portion 26 which is optionally provided with a hollow interior chamber 27 for reasons that will be explained in greater detail further on in the specification.

Figure 3:
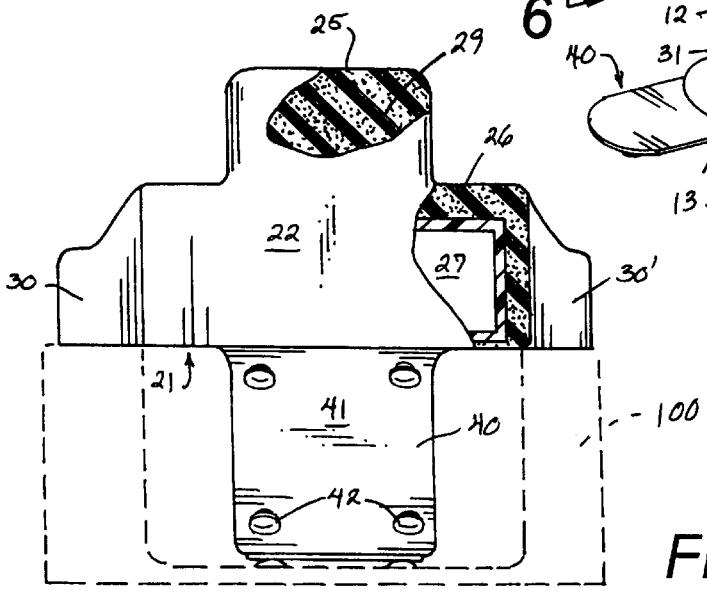
FIG. 3 is a partial cut-away rear elevation view of the support apparatus.

In addition, as shown in FIGS. 1 and 2, the raised headrest portion 25 of the cushioned support member 20 is optionally provided with a shallow recess 28 dimensioned to receive the back of a user's head; and, as shown in FIG. 3, the body of the cushioned support member 20 may be fabricated from a closed cell foam 29 or other waterproof material that is suitable for molding into the desired contours.

Turning now to FIGS. 2 through 6, it can be seen that the pair of arm units 12 12 are formed integrally with the upper body cushioned support member 20 and include a pair of extension arm members 30 30' that slope downwardly and project forwardly from the upper backrest portion 26 of the cushioned support member 20 wherein the free ends 31 of the extension arm members 30 30' have a generally flat top surface 32 provided with a plurality of contoured recesses 33 34.

Figure 5:
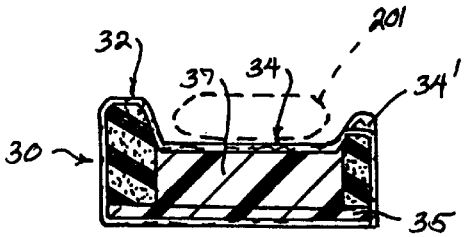
FIG. 5 is a cross-sectional view taken through line 5—5 of FIG. 1.
Figure 6:
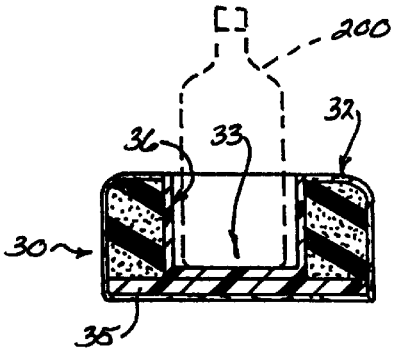
FIG. 6 is a cross-sectional view taken through line 6—6 of FIG. 2.

In addition, as can best be appreciated by reference to FIGS. 5 and 6, each of the extension arm members 30 30' is provided with an elongated stiffening element 35 to provide lateral rigidity to the otherwise flexible arm members 30 30' and the contoured recesses 33 34 can likewise be provided with generally rigid liners 36 or underlying support elements 37.

Still referring to FIGS. 5 and 6, it can be seen that in the preferred embodiment of the invention, at least some of the contoured recesses 33 will have a generally cylindrical configuration so as to accommodate liquid filled receptacles 200 and maintain them in a vertically upright spill proof arrangement; and, at least one of the other contoured receptacles 34 will have a shallow contour and an optional auxiliary drainage recess 34' so as to function as a self-draining soap dish or the like, wherein, the drainage recess 34' is directed toward the interior edge of either or both extension arm members 30 30'.

Figure 4:
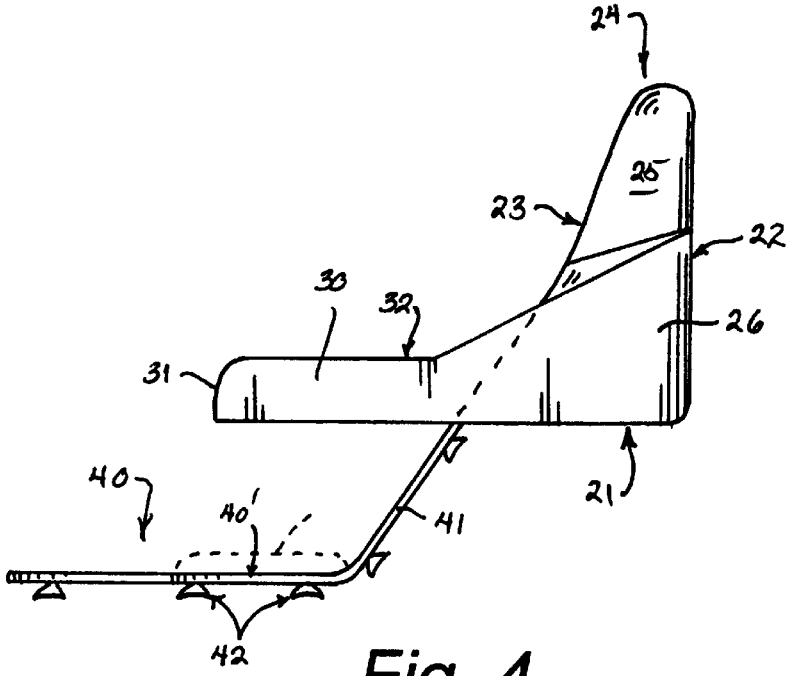
FIG. 4 is a side elevation view of the support apparatus.

As shown in FIGS. 2 through 4, the lower body friction unit 13 comprises an elongated friction skirt member 40 which depends downwardly from the angled front face 23 of the upper body cushioned support member 20 wherein the friction skirt member 40 is fabricated from a high co-efficient of friction material 41 such as rubber or the like, the bottom surface of which is provided with a plurality of suction cup elements 42 to releasably secure the friction skirt member to a selected sidewall and the bottom of a bathtub.

In addition, as depicted in FIGS. 2 and 4, the intermediate portion 40' of the friction skirt member 40 may be optionally provided with a seat cushion element 45 depicted in phantom; wherein, the friction skirt member 40 per se is intended to prevent the user of the support apparatus from slipping downwardly on the smooth generally friction-less sidewalls of a conventional tub 100 once the user has found a comfortable position relative to the upper body support unit 11 and the arm units 12 12, and wherein the seat cushion element 45 is optionally provided as an added comfort feature.

Returning now to FIG. 3, it should be noted that the hollow interior chamber 27 in the cushioned support member 20 is provided to house optional accessories commonly found in many prior art tub cushion constructions, such as heating elements, vibrating mechanisms, and even battery operated audio components. However, the aforementioned accessories or combinations thereof are not intended to form a crucial part of the present invention.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A removable cushioned support apparatus in combination with a conventional bathtub/spa, said bathtub/spa having a plurality of sidewalls with each of said sidewall having an upper rim, comprising:

a main upper body support unit including an enlarged contoured cushioned support member having an upper back rest portion provided with a centrally disposed raised headrest portion; and, a pair of arm units connected to the cushioned support member and extending forwardly therefrom in a generally parallel fashion wherein each arm unit includes an extension arm member provided with a plurality of contoured recesses formed on a generally flat top surface of said extension arm member and dimensioned to receive and support a bath accessory, said removable cushioned support apparatus is supported on the upper rims via said pair of arm units and extension arm members.

2. The support apparatus as in claim 1; wherein, at least one of the plurality of contoured recesses has a cylindrical configuration.

3. The support apparatus as in claim 1; wherein, at least one of the plurality of contoured recesses has a shallow configuration.

4. The support apparatus as in claim 3; wherein, said shallow configured recess is further provided with an inwardly directed drain recess.

5. The support apparatus as in claim 1; wherein, the plurality of contoured recesses in both of the extension arm members includes at least one contoured recess having a cylindrical configuration and at least one other contoured recess having a shallow configuration.

6. The support apparatus as in claim 5; wherein, the extension arm members are formed integrally with the cushioned support member.

7. The support apparatus as in claim 5; wherein, said cushioned support member has an angled front face.

8. The support apparatus as in claim 7; further comprising:

a lower body friction unit supported by and suspended below the upper body support unit wherein, the lower body friction unit includes an elongated friction skirt member.

9. The support apparatus as in claim 8; wherein, the elongated friction skirt member has a bottom surface provided with a plurality of suction cups.

10. The support apparatus as in claim 9; wherein, the upper back rest portion of the cushioned support member is provided with a hollow interior chamber.

11. The support apparatus as in claim 1; wherein, the extension arm members are formed integrally with the cushioned support member.

12. The support apparatus as in claim 1; wherein, said cushioned support member has an angled front face.

13. The support member as in claim 12; further comprising:

a lower body friction unit supported by and suspended below the upper body support unit wherein, the lower body friction unit includes an elongated friction skirt member.

14. The support apparatus as in claim 13; wherein, the elongated friction skirt member has a bottom surface provided with a plurality of suction cups.

* * * * *